US009725960B2

(12) United States Patent
Chen

(10) Patent No.: US 9,725,960 B2
(45) Date of Patent: Aug. 8, 2017

(54) CUTTERS FOR DRILL BITS

(71) Applicant: Halliburton Energy Services, Inc., Houston, TX (US)

(72) Inventor: Shilin Chen, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 369 days.

(21) Appl. No.: 14/374,545

(22) PCT Filed: Aug. 30, 2013

(86) PCT No.: PCT/US2013/057511

§ 371 (c)(1),
(2) Date: Jul. 25, 2014

(87) PCT Pub. No.: WO2015/030791

PCT Pub. Date: Mar. 5, 2015

(65) Prior Publication Data

US 2015/0300095 A1 Oct. 22, 2015

(51) Int. Cl.

| | |
|---|---|
| ***E21B 10/567*** | (2006.01) |
| ***E21B 10/573*** | (2006.01) |
| ***E21B 7/00*** | (2006.01) |
| ***E21B 10/55*** | (2006.01) |

(52) U.S. Cl.

CPC ..... *E21B 10/5735* (2013.01); *E21B 7/00* (2013.01); *E21B 10/55* (2013.01); *E21B 10/567* (2013.01); *E21B 10/5673* (2013.01)

(58) Field of Classification Search

CPC ..... E21B 10/5735

USPC ..... 175/431, 432

See application file for complete search history.

(56) References Cited

U.S. PATENT DOCUMENTS

| | | | | |
|---|---|---|---|---|
| 4,350,215 | A | 9/1982 | Radtke | |
| 4,660,659 | A | 4/1987 | Short, Jr. et al. | |
| 4,804,049 | A | 2/1989 | Barr | |
| 5,467,837 | A | 11/1995 | Miller et al. | |
| 5,487,436 | A * | 1/1996 | Griffin | E21B 10/567 175/432 |
| 5,711,702 | A | 1/1998 | Devlin | |

(Continued)

FOREIGN PATENT DOCUMENTS

| | | | |
|---|---|---|---|
| WO | 2011058532 | A2 | 5/2011 |
| WO | 2013010063 | A1 | 1/2013 |
| WO | 2015030791 | A1 | 3/2015 |

OTHER PUBLICATIONS

International Search Report and Written Opinion for PCT/US2013/057511 dated May 20, 2014.

(Continued)

*Primary Examiner* — Giovanna C Wright

(74) *Attorney, Agent, or Firm* — McDermott Will & Emery LLP

(57) ABSTRACT

Disclosed are improved cutters for fixed-cutter rotating drill bits. One cutter includes a substrate defining a slot therein and being configured to be coupled to a middle portion of a blade of the drill bit, and a cutting element secured within the slot and having at least a portion of the cutting element extending out of the slot, the cutting element further having a first face and a second face, wherein portions of the first and second faces are supported by the substrate within the slot.

20 Claims, 8 Drawing Sheets

(56) References Cited

U.S. PATENT DOCUMENTS

| | | | | |
|---|---|---|---|---|
| 6,315,066 | B1 * | 11/2001 | Dennis | E21B 10/5676 175/431 |
| 7,533,740 | B2 | 5/2009 | Zhang et al. | |
| 7,836,981 | B2 * | 11/2010 | Zhang | E21B 10/5676 175/430 |
| 7,909,121 | B2 * | 3/2011 | Voronin | B22F 7/062 175/426 |
| 7,971,663 | B1 | 7/2011 | Vail | |
| 8,002,054 | B2 | 8/2011 | Swope et al. | |
| 8,146,687 | B1 | 4/2012 | Vail | |
| 2001/0020551 | A1 * | 9/2001 | Taylor | E21B 10/42 175/57 |
| 2002/0096369 | A1 | 7/2002 | Glowka et al. | |
| 2009/0173548 | A1 | 7/2009 | Voronin et al. | |
| 2009/0183925 | A1 | 7/2009 | Zhang et al. | |
| 2010/0122848 | A1 * | 5/2010 | McClain | E21B 10/43 175/57 |
| 2010/0187019 | A1 | 7/2010 | Swope et al. | |
| 2012/0261196 | A1 * | 10/2012 | Yu | E21B 10/46 175/428 |
| 2013/0167451 | A1 * | 7/2013 | Lin | E21B 10/5673 51/309 |
| 2015/0300095 | A1 | 10/2015 | Chen | |

OTHER PUBLICATIONS

Office Action received in corresponding Chinese Application No. 201380078210.6 dated Jul. 29, 2016, with translation.

* cited by examiner

CUTTERS FOR DRILL BITS

BACKGROUND

The present disclosure relates to earth-penetrating drill bits and, more particularly, to fixed-cutter rotating drill bits used for drilling oil and gas wells.

Wellbores for the oil and gas industry are commonly drilled by a process of rotary drilling. In conventional vertical drilling a drill bit is mounted on the end of a drill string (i.e., drill pipe plus drill collars, etc.), which may be several miles long. At the surface of the well, a rotary drive turns the drill string, including the drill bit arranged at the bottom of the hole, while drilling fluid (or "mud") is pumped through the drill string. In other drilling operations, the drill bit may be rotated using a mud motor arranged axially adjacent the drill bit in the downhole environment and powered using the mud circulated from the surface.

When the drill bit wears out or breaks during drilling, it must be brought up out of the hole. This requires "tripping" the drill string out of the wellbore, which typically involves a heavy hoist pulling the entire drill string out of the hole in stages of, for example, about ninety feet of drill pipe at a time. Since the drill string may extend tens of thousands of feet into the earth, one tripping job can be quite time-consuming and expensive. To resume drilling, a new or refurbished drill bit is attached to the end of the drill pipe and subsequently lowered into the wellbore, and the foregoing process is then reversed until the bit reaches the bottom of the well and drilling can recommence. As can be appreciated, in order to minimize round trips for bit replacement during drilling, the durability and robustness of drill bits are very important features.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to earth-penetrating drill bits and, more particularly, to fixed-cutter rotating drill bits used for drilling oil and gas wells.

The present disclosure provides various embodiments of cutters used in fixed-cutter drill bits. The cutters may include a substrate that defines or otherwise provides a slot configured to receive and otherwise secure therein a cutting element used to cut through rock formations and the like during drilling operations. Each cutting element may define opposing front and back faces. Inserting or otherwise embedding the cutting elements at least partially within the slot of the substrate allows the portions of the front and back faces to be in direct contact with and otherwise supported by the substrate. Since both the front and back faces are directly interfaced with the substrate, any resulting stresses placed on the cutting element as it turns either normally or in reverse bit rotation will be assumed by the cutter in compression against the substrate. As a result, the cutter may be able to be subjected to cutting forces in either rotational direction without risking severe damage to the cutting element.

Figure 1:
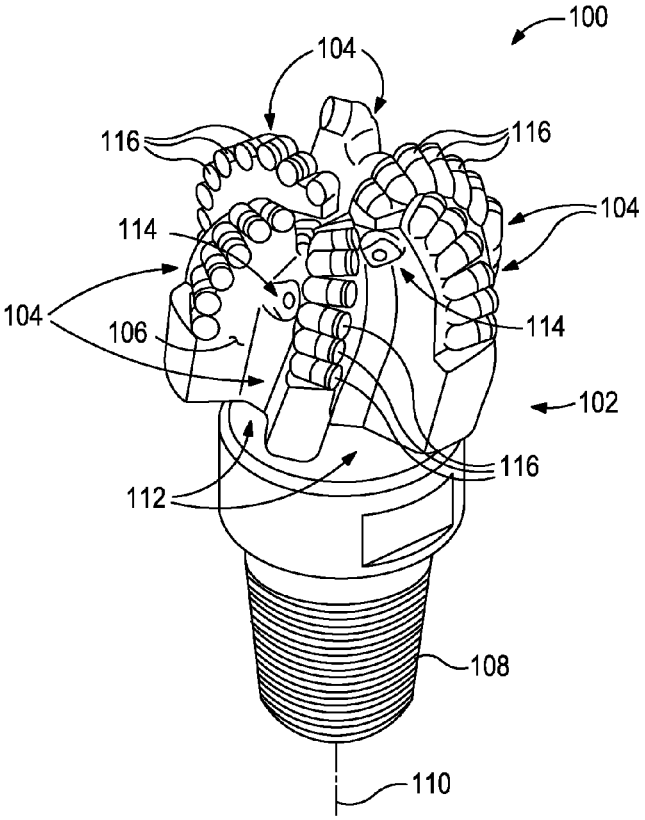
FIG. 1 illustrated is an exemplary art fixed-cutter drill bit.

Referring to FIG. 1, illustrated is an exemplary fixed-cutter drill bit 100. The drill bit 100 has a bit body 102 that includes radially and longitudinally extending blades 104 having leading faces 106, and a threaded pin connection 108 for connecting the bit body 102 to the drill string (not shown). The bit body 102 may be made of steel or a matrix of a harder material, such as tungsten carbide. The bit body 102 defines a leading end structure for drilling into a subterranean formation by rotation about a longitudinal axis 110 and application of weight-on-bit. Corresponding junk slots 112 are defined between circumferentially adjacent blades 104, and a plurality of nozzles or ports 114 are arranged within the junk slots 112 for ejecting drilling fluid that cools the drill bit 100 and otherwise flushes away cuttings and debris generated during drilling.

The bit body 102 further includes a plurality of fixed teeth or cutters 116, which typically comprise a substrate made of an extremely hard material (e.g., tungsten carbide) and faced with one or more layers of a super-hard material (e.g., polycrystalline diamond, impregnated diamond, etc.). When using polycrystalline diamond as the super-hard material, such cutters are often referred to as polycrystalline diamond compact cutters or "PDC cutters." As the drill string is rotated, the cutters 116 are pushed through the rock by the combined forces of the weight-on-bit and the torque seen at the drill bit 100. With recent improvements in impact resistance and wear resistance, PDC cutters manufactured today may drill through increasingly harder formations, which previously required roller cone bits or impregnated diamond bits.

However, it is still very difficult for PDC cutters to penetrate very hard formations due to impact damage that may occur to its cutting elements. Most PDC cutter impact damage is due to bit vibration while penetrating hard formations. Cutter damage most often occurs in the form of impact damages including cracked, lost, or chipped cutting element. Experiments have confirmed that bit torsional vibration, backward whirling, and even stick-slip may cause "reverse bit rotation" or rotation backwards of the drill bit. Once a drill bit is in reverse rotation, the cutting elements on each cutter may be chipped or otherwise damaged after a short period of time.

Figure 2A:
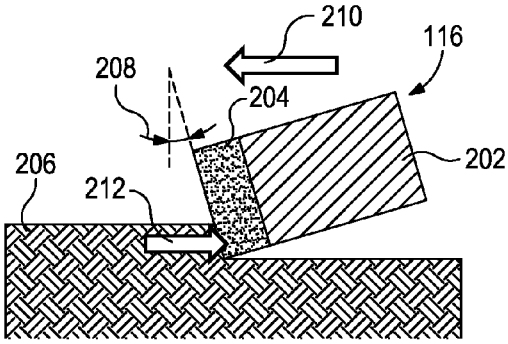
FIG. 2A illustrates an exemplary cutter rotating in a normal cutting direction.
Figure 2B:
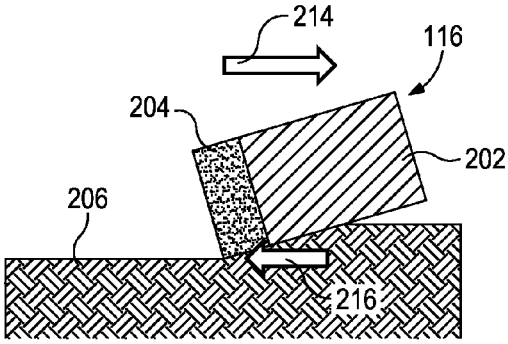
FIG. 2B illustrates the cutter of FIG. 2A during reverse bit rotation.

Referring to FIGS. 2A and 2B, with continued reference to FIG. 1, illustrated is a PDC cutter 116. As illustrated, the PDC cutter 116 may include a substrate 202 with a cutting element 204 attached at its end and configured to cut through underlying portions of a formation 206. The substrate 202 may be made of a hard material, such as tungsten carbide, and the cutting element 204 is made of any super-hard material, such as polycrystalline diamond. Each PDC cutter 116 generally forms a cylindrical structure and the carbide substrate 202 is brazed onto a corresponding blade 104 (FIG. 1) of the drill bit 100 (FIG. 1). While drilling the formation 206, the PDC cutter 116 will typically have a back rake angle 208 that ranges from about 10° to about 30° from vertical.

FIG. 2A shows the PDC cutter 116 operating during normal drilling operations where the PDC cutter 116 is rotated to cut the formation 206 in a first direction 210. As the PDC cutter 116 moves in the first direction 210, a resulting compressive cutting force 212 is applied to the cutting face of the cutting element 204 as supported by the carbide substrate 202 and the blade 104. Since the compression strength of the interface between the cutting element 204 and the carbide substrate 202 is quite high, there is a low likelihood that the cutting element 204 will be chipped from the substrate 202 or otherwise damaged in compression.

FIG. 2B, on the other hand, depicts the PDC cutter 116 rotating in a second direction 214 while cutting the formation 206. The second direction 214 is opposite the first direction 210 and representative of reverse bit rotation that results from at least one of torsional vibration, backward whirl, and stick-slip vibration propagating through the drill string. As the PDC cutter 116 rotates in the second direction 214, a resulting tensile cutting force 216 is applied to the cutting element 204. Since the tensile strength at the interface between the cutting element 204 and the substrate 202 is quite low, the cutting element 204 may be chipped or otherwise lost within a short period of time while in reverse bit rotation. It may prove advantageous to have a PDC cutter that is able to be subjected to reverse bit rotation without resulting in significant damage to the cutting element applied to the substrate.

Figure 3:
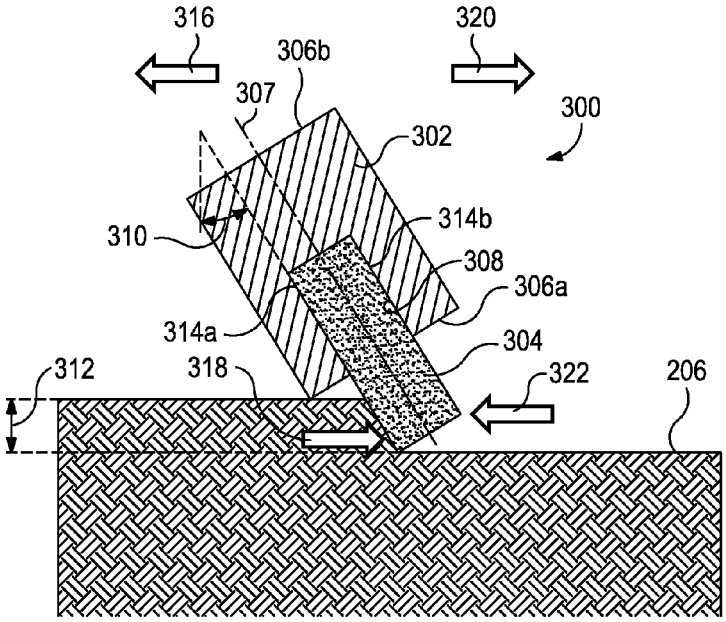
FIG. 3 illustrates a cross-sectional view of an exemplary cutter, according to one or more embodiments of the present disclosure.

Referring to FIG. 3, illustrated is a cross-sectional view of an exemplary cutter 300 that may be used in a fixed-cutter or drag-type drill bit, according to one or more embodiments of the present disclosure. The cutter 300 may be similar in at least some respects to the cutter 116 of FIGS. 2A and 2B and therefore may be best understood with reference thereto. Several cutters 300 may be used in conjunction with the drill bit 100 of FIG. 1 (or similar fixed-cutter bits) and otherwise replace one or more of the cutters 116 depicted therein. As illustrated, the cutter 300 may include a substrate 302 and a cutting element 304 secured or otherwise attached to the substrate 302.

In some embodiments, the substrate 302 may be made of a hard material such as, but not limited to, tungsten carbide, or cemented carbide. Cemented carbide may contain varying proportions of titanium carbide (TiC), tantalum carbide (TaC) and niobium carbide (NbC). The cutting element 304 may be made of a layer or layers of super-hard materials such as, but not limited to, polycrystalline diamond, thermal stable polycrystalline diamond, impregnated diamond, nanocrystalline diamond, and ultra-nanocrystalline diamond.

The substrate 302 may be generally cylindrical in shape and have opposing first and second ends 306*a* and 306*b*, respectively, spaced from each other along a longitudinal axis 307. The first end 306*a* of the cylindrical substrate 302 may define an axially-extending slot 308 configured to receive and secure the cutting element 304 therein. In some embodiments, the cutting element 304 may be press-fit into the slot 308, thereby forming an interference fit between the two components. In other embodiment, however, the cutting element 304 may be secured within the slot 308 using adhesives or brazing techniques, without departing from the scope of the disclosure. In other embodiments, the cutting element 304 may be secured within the slot 308 using mechanical means, such as those described in co-owned U.S. Pat. No. 8,336,648, which discloses various means of mechanical attachment of thermally stable diamond to substrate.

The second end 306*b* of the cylindrical substrate 302 may be configured to be inserted into a corresponding hole defined in a blade 104 (FIG. 1) provided on the drill bit body 102 (FIG. 1). In some embodiments, the cutter 300 may be secured to the blade 104 such that a back rake angle 310 for the cutter 300 results. The back rake angle 310 may be configured to facilitate easier penetration of the underlying portions of the formation 206. The back rake angle 310 may range from about 10° to about 30° from vertical depending, at least in part, on the hardness of the formation 206 being drilled.

The cutting element 304 may define a front face 314*a* and a back face 314*b*. Since the cutting element 304 is at least partially inserted or otherwise embedded within the substrate 302, portions of both the front and back faces 314*a,b* are in direct contact and otherwise supported by the substrate 302. As a result, the cutting element 304 may be supported and protected in both rotational cutting directions of the drill bit since the interfaces between the front and back faces 314*a,b* and the substrate 302 result in compressive forces being applied to the cutting element 304 in either direction.

For example, the cutter 300 may be configured to rotate in a first direction 316 while cutting the formation 206 during normal drilling operations. As the cutter 300 advances in the first direction 316, a resulting compressive cutting force 318 is applied to the front face 314*a* of the cutting element 304. Since the back face 314*b* of the cutting element 304 is supported in compression by the substrate 302, there is a low likelihood that the cutting element 304 will be damaged while rotating in the first direction 316.

While drilling, however, the cutter 300 may be subjected to reverse bit rotation where the cutter 300 is rotated in a second direction 320 opposite the first direction 316. As mentioned above, such reverse bit rotation may result from at least one of torsional vibration, backward whirl, and stick-slip vibration propagating through the drill string (not shown). In the event the cutter 300 is rotated in the second direction 320, the back face 314*b* of the cutting element 304 may be subjected to a second resulting compressive cutting force 322 while advancing through the formation 206 in the second direction 320. The second compressive cutting force 322 may act on the cutting element 304 opposite the first compressive cutting force 318. Nevertheless, since the front face 314*a* of the cutting element 304 is supported in compression by the substrate 302, there is a decreased likelihood that the cutting element 304 will be damaged if the cutter 300 rotates in the second direction 320.

Accordingly, since both the front and back faces 314*a,b* of the cutting element 304 are directly interfaced with the substrate 302, any resulting stresses placed on the cutting element 304 as it turns either normally (i.e., the first direction 316) or in reverse bit rotation (i.e., the second direction 320) will be assumed by the cutter 300 in compression against the substrate 302. As a result, the cutter 300 may be able to be subjected to both cutting forces 318, 322 without risking severe damage to the cutting element 304.

Figure 4A:
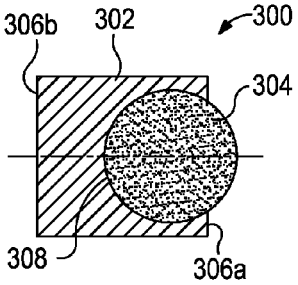
FIGS. 4A-4P illustrate several different embodiments of the cutter of FIG. 3 that may be implemented, according to the present disclosure.
Figure 4B:
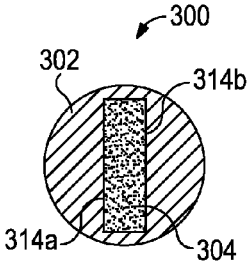
Figure 4C:
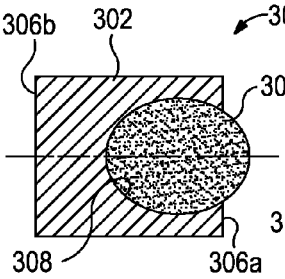
Figure 4D:
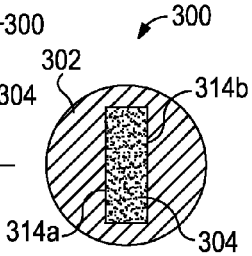
Figure 4E:
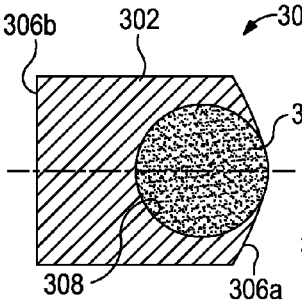
Figure 4F:
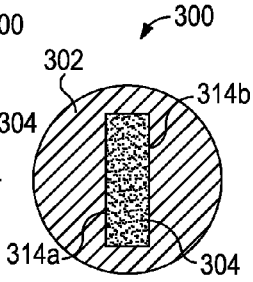
Figure 4G:
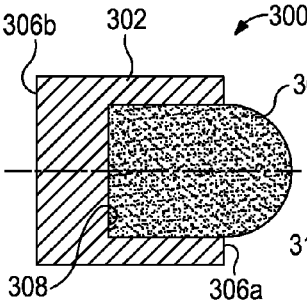
Figure 4H:
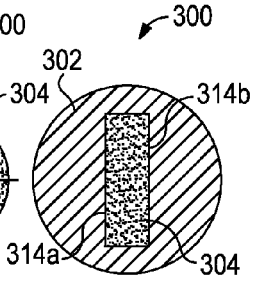
Figure 4I:
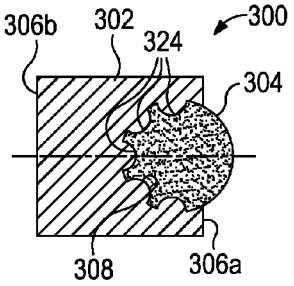
Figure 4J:
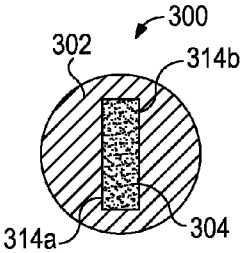
Figure 4K:
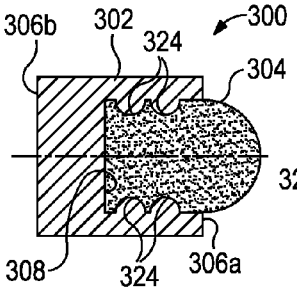
Figure 4L:
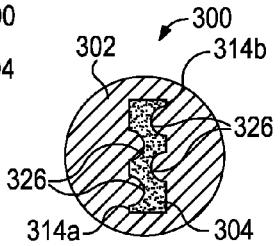
Figure 4M:
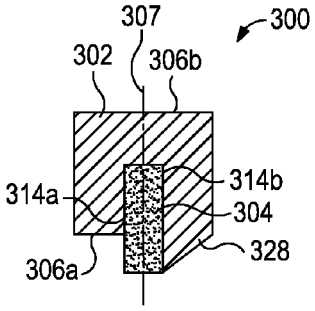
Figure 4N:
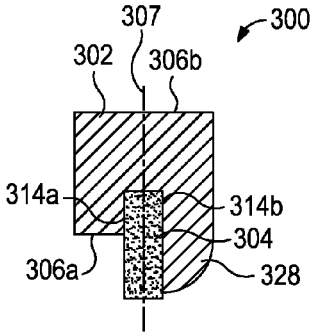
Figure 4O:
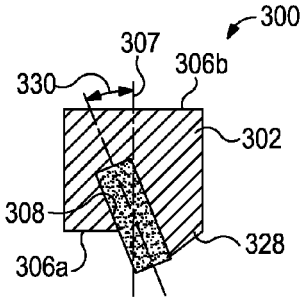
Figure 4P:
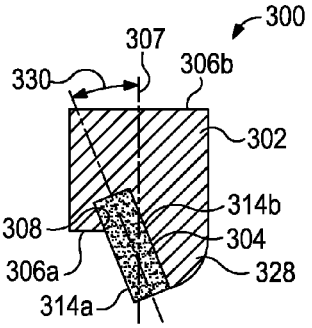

Referring now to FIGS. 4A-4P, with continued reference to FIG. 3, illustrated are several different embodiments of the cutter 300 that may be implemented, according to the present disclosure. In FIGS. 4A and 4B, illustrated are cross-sectional side and end views, respectively, of one embodiment of the cutter 300. As illustrated, the cutting element 304 may be generally circular or disc-shaped and secured within the slot 308 defined in the substrate 302. At least a portion of the cutting element 304 may extend past and otherwise out of the first end 306*a* of the substrate 302. As such, the exposed portion of the cutting element 304 may be configured to contact and cut the formation 206 (FIG. 3) during drilling.

In FIGS. 4C and 4D, illustrated are cross-sectional side and end views, respectively, of another embodiment of the cutter 300. As illustrated, the cutting element 304 may be generally ovoid or elliptical in shape. Again, as secured within the slot 308, at least a portion of the cutting element 304 extends past and otherwise out of the first end 306*a* of the substrate 302 in order to make contact with and cut the formation 206 (FIG. 3) during drilling. As will be appreciated, ellipses or oval-shaped cutting elements 304 may be advantageous over circular-shaped cutting elements 304 (e.g., FIGS. 4A and 4B) since more surface area of the cutting element 304 may be interfaced with the substrate 302 using ellipses or oval-type cutting elements 304. As a result, the useful life of the cutter 300 may be extended.

In FIGS. 4E and 4F, illustrated are cross-sectional side and end views, respectively, of another embodiment of the cutter 300. Similar to the cutting element 304 of FIGS. 4A and 4B, the cutting element 304 in FIGS. 4E and 4F may be circular or disc-shaped. Unlike FIGS. 4A and 4B, however, the cutting element 304 in FIGS. 4E and 4F extends out of the first end 306*a* of the substrate 302 only a short distance in order to make contact with and cut the formation 206 (FIG. 3) during drilling. In other words, the cutting element 304 may either be inserted further into the substrate 302 or the substrate 302 may surround more surface area of the cutting element 304 than in the embodiment shown in FIGS. 4A and 4B. Since there is more substrate 302 protecting or otherwise supporting the cutting element 304, such an embodiment may prove advantageous for cutting through formations 206 (FIG. 3) made of harder rock. Moreover, the depth of cut 312 (FIG. 3) for such an embodiment may be quite small, such as around 0.05 inches or less per one revolution of the bit.

In FIGS. 4G and 4H, illustrated are cross-sectional side and end views, respectively, of another embodiment of the cutter 300. As illustrated, the cutting element 304 may be generally shaped as a "bullnose" or an arched or arcuate polygon. A semi-circular or arched portion of the bullnose or arcuate polygon extends past and otherwise out of the first end 306*a* of the substrate 302 in order to make contact with and cut the formation 206 (FIG. 3) during drilling. Similar to the cutting element 304 of FIGS. 4C and 4D, the cutting element 304 of FIGS. 4G and 4H may prove advantageous in providing more surface area of the cutting element 304 interfaced with the substrate 302, and thereby resulting in a more robust cutter 300 and extended useful life thereof.

In FIGS. 4I and 4J, illustrated are cross-sectional side and end views, respectively, of another embodiment of the cutter 300. As illustrated, the cutting element 304 may be generally circular or disc-shaped, but may further provide a non-linear interface between the slot 308 and the portion of the cutting element 304 that is embedded within the slot 308. More particularly, the cutting element 304 may define one or more grooves or notches 324 that may be spaced about the periphery of the portion of the cutting element 304 embedded within the slot 308. The remaining portion of the cutting element 304 extends past and otherwise out of the first end 306*a* of the substrate in order to make contact with and cut the formation 206 (FIG. 3) during drilling. The notches 324 may prove advantageous in increasing the strength of the bond between the cutting element 304 and the substrate 302, thereby resulting in a more robust cutter 300.

In FIGS. 4K and 4L, illustrated are cross-sectional side and end views, respectively, of another embodiment of the cutter 300. Similar to the cutter 300 of FIGS. 4G and 4H, the cutting element 304 in FIGS. 4K and 4L may be generally shaped as an arched or arcuate polygon (i.e., a bullnose), where a semi-circular or arched portion of the arcuate polygon extends past and otherwise out of the first end 306*a* of the substrate 302. Moreover, similar to the cutter 300 of FIGS. 4I and 4J, the cutter 300 of FIGS. 4K and 4L may define a non-linear interface between the slot 308 and the cutting element 304 in the form of one or more grooves or notches 324 defined about the periphery of the portion of the cutting element 304 embedded within the slot 308.

One or more additional grooves or notches 326 may further be provided or otherwise defined in one or both of the front and back faces 314*a,b* of the cutting element 304, as depicted in FIG. 4L. In at least one embodiment, the notches 326 may be longitudinally-extending channels extending across at least a portion of the length of the cutting element 304. In other embodiments, however, the notches 326 may be transversely-extending channels extending across at least a portion of the width of the cutting element 304. Again, the notches 324 and 326 may prove advantageous in increasing the strength of the bond between the cutting element 304 and the substrate 302.

In FIGS. 4M-4P, illustrated are cross-sectional side views, respectively, of other possible embodiments of the cutter 300. More particularly, the cutters 300 shown in FIGS. 4M-4P may exhibit one or more variations to the substrate 302. In FIGS. 4M and 4N, for example, the substrate 302 may provide an extension 328 that extends longitudinally from the first end 306*a* such that all or a significant portion of the back face 314*b* of the cutting element 304 is in direct contact with the substrate 302. As a result, the cutting element 304 may be better able to resist the compressive cutting forces 318 (FIG. 3) against the front face 314*a* when the cutter 300 is rotated in the first direction 316 (FIG. 3). Moreover, however, a portion of the front face 314*a* of the cutting element 304 remains in direct contact with the substrate 302 so as to provide resistance against the second compressive cutting forces 322 (FIG. 3) when the cutter 300 is in reverse bit rotation in the second direction 320 (FIG. 3).

In some embodiments, the extension 328 may be angled toward the back face 314*b*, as shown in FIG. 4M. In other embodiments, however, the extension 328 may be arcuate as extending toward the back face 314*b*, as provided in FIG. 4N. Preference for having an angled or arcuate extension 328 in the design of the cutter 300 may depend at least in part on manufacturing capabilities and cost constraints. Advantageously, the angled or arcuate extension 328 may provide less contact surface area with the formation in case of bit reverse rotation.

Similar to the cutters 300 in FIGS. 4M and 4N, the cutters 300 in FIGS. 4O and 4P may include the extension 328, as generally described above. In other embodiments, however, the extension 328 may be omitted from such embodiments, without departing from the scope of the disclosure. As illustrated, the cutting element 304 of FIGS. 4O and 4P may be inserted into the slot 308 or otherwise secured therein at an angle 330 with respect to the longitudinal axis 307 of the substrate 302. In some embodiments, the angle 330 may be substantially similar to the back rake angle 310 of FIG. 3. In other embodiments, the angle 330 may complement the back rake angle 310, thereby providing the cutting element 304 with a steeper angle of impingement on the formation 206 (FIG. 3).

Those skilled in the art will readily recognize that cutters, such as the cutters 300 of FIGS. 4A-4N, are coupled to the blades 104 (FIG. 1) at an angle configured to provide the desired back rake angle 310 (FIG. 3). To accomplish this, angled holes are defined in the body of each blade 104 such that the cutters 300 may be introduced into the holes at said angle, thereby resulting in each of the cutting elements 304 being positioned at the desired back rake angle 310. In embodiments where the angle 330 is substantially similar to the back rake angle 310 of FIG. 3, however, the holes defined in the body of the blades 104 to receive the cutters 300 may be substantially perpendicular to the blade surfaces. The desired back rake angle for the cutters 300 may instead be achieved through the cutting element 304 being secured within the slot 308 at the angle 330.

As will be appreciated, such embodiments may prove advantageous during manufacturing of the bit since the hole in the blades 104 for receiving the cutters 300 shown in FIGS. 4O and 4P need only be drilled perpendicular to the surface of the blades 104 in a bit radial plane rather than at an angle from perpendicular intended to provide the back rake angle 310 (FIG. 3). It will further be appreciated, however, that any of the cutters 300 depicted in FIGS. 4A-4N may equally be secured within the slot 308 of the substrate 302 at the angle 330, without departing from the scope of the disclosure.

Figure 5A:
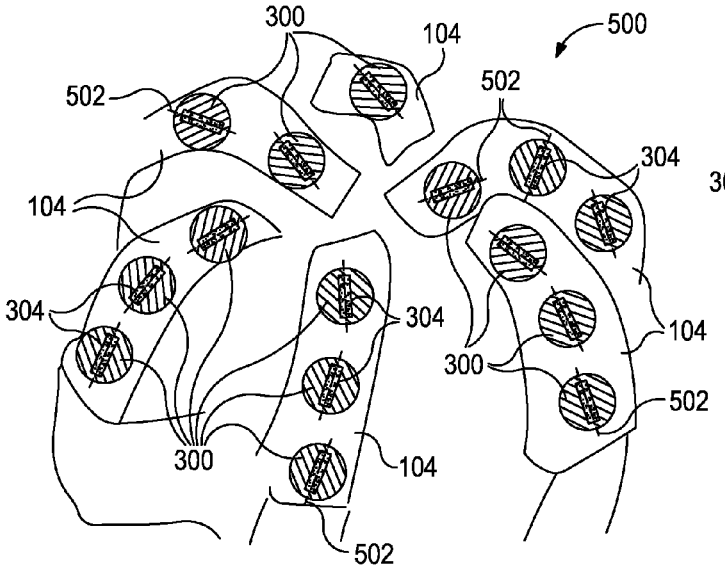
FIG. 5A illustrates a schematic diagram of an exemplary drill bit configured to receive and secure the cutters of FIGS. 4A-4P, according to one or more embodiments.

Referring now to FIG. 5A, with continued reference to FIG. 3 and FIGS. 4A-4P, illustrated is a schematic diagram of an exemplary drill bit 500 configured to receive and secure the cutters 300, according to one or more embodiments. The drill bit 500 may be similar in some respects to the drill bit 100 of FIG. 1 and may therefore be best understood with reference thereto, where like numerals represent like elements not described again. The basic design of the drill bit 500 is depicted in FIG. 5A for illustrative purposes only and for the intent of showing the general placement of the cutters 300 described above on the drill bit 500.

As illustrated, the drill bit 500 may include a plurality of blades 104 and the cutters 300 may be strategically coupled to the blades 104. The cutters 300 shown in FIG. 5A may be any of the cutters 300 described above with reference to FIGS. 4A-4P. In some embodiments, a combination of the different types of cutters 300 of FIGS. 4A-4P may be employed, without departing from the scope of the disclosure. Each cutter 300 may be attached to the corresponding blades 104 by brazing or other known attachment means. Since each cutter 300 is able to adequately undertake compressive forces 318, 322 (FIG. 3) in either direction 316, 320 (FIG. 3), either the front of each blade 104 or its back (or both) may be designed to control the depth of cut 312 (FIG. 3) for the drill bit 500.

Each cutter 300 may be generally arranged in the middle (i.e., generally centralized between the front and back of each blade 104) of its corresponding blade 104 and the cutting element 304 of each cutter 300 may be generally aligned with the geometry of the blade 104. In other words, each cutting element 304 may include a widthwise axis 502 that may be aligned with the geometry of the blade 104 at the point at which it is coupled thereto. In some embodiments, the angle of the axis 502 with respect to the geometry of the corresponding blade 104 may be altered, depending on the type of rock to be drilled or the hardness of the formation 206 (FIG. 3). Since the cutter 500 is generally arranged in the middle of its corresponding blade 104, either the front of each blade 104 or its back (or both) may be designed to control the depth of cut 312 (FIG. 5) for the drill bit 500.

Figure 5B:
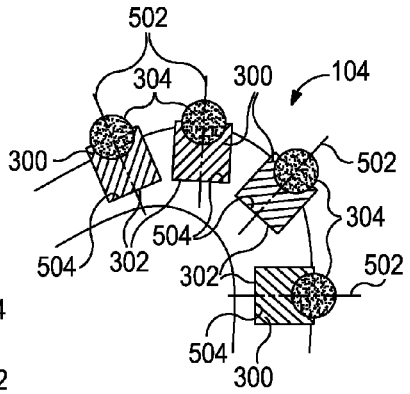
FIG. 5B illustrates a cross-sectional view of one of the blades of the drill bit of FIG. 5A, according to one or more embodiments.

Referring to FIG. 5B, illustrated is a cross-sectional view of one of the blades 104 of FIG. 5A, according to one or more embodiments. While the cutters 300 depicted in FIG. 5B appear similar to the cutters 300 of FIGS. 4A and 4B, it will be appreciated that the cutters 300 may be any of the cutters 300 described above with reference to FIGS. 4A-4P, or any combination thereof, without departing from the scope of the disclosure. As discussed above, each of the cutters 300 may be attached to the blade 104 by being inserted into and brazed to a corresponding hole 504 defined in the blade 104. The bond strength between the substrate 302 and blade 104 may be enhanced due to the increased braze surface area.

Figure 6:
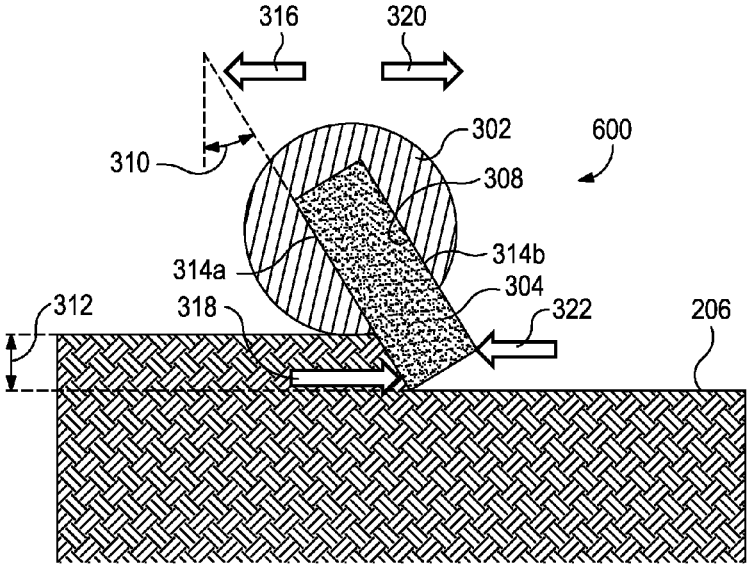
FIG. 6 illustrates a cross-sectional view of another exemplary cutter, according to one or more embodiments of the present disclosure.

Referring now to FIG. 6, illustrated is a cross-sectional view of another exemplary cutter 600, according to one or more embodiments of the present disclosure. The cutter 600 may be similar in at least some respects to the cutter 300 of FIG. 3 and therefore may be best understood with reference thereto. Similar to the cutter 300 of FIG. 3, the cutter 600 may include a substrate 302 and a cutting element 304 secured or otherwise attached to the substrate 302. Unlike the cutter 300 of FIG. 3, however, the substrate 302 of the cutter 600 may be generally spherical in shape. As used herein, the term "spherical" as applied to the substrate 302 is intended to encompass any arcuate or circular volume or shape including, but not limited to, elliptical or ovoid volumes, such as is depicted in FIGS. 7E and 7F.

A slot 308 may be defined in the substrate 302 for receiving and securing the cutting element 304 therein, as generally described above. At least a portion of the cutting element 304 may extend out of the slot 308 in order to make contact with and cut the formation 206. At a point somewhat radially opposite the protruding location of the cutting element 304, the substrate 302 may be configured to be inserted into a corresponding hole defined in a blade provided on a drill bit body, as will be discussed in more detail below. In some embodiments, the cutter 600 may be secured to the blade 104 at the back rake angle 310 described above.

Again, the cutting element 304 may define a front face 314*a* and a back face 314*b*. Since the cutting element 304 is at least partially inserted or otherwise embedded within the substrate 302, portions of the front and back faces 314*a,b* are in direct contact with and otherwise supported by the substrate 302. As a result, the cutting element 304 may be supported and protected in both rotational cutting directions 316, 320 as coupled to the bit. More particularly, since both the front and back faces 314*a,b* are directly interfaced with the substrate 302, any resulting stresses placed on the cutting element 304 as it turns either normally (i.e., the first direction 316) or in reverse bit rotation (i.e., the second direction 320) will be assumed by the cutter 600 in compression against the substrate 302. As a result, the cutter 600 may be able to be subjected to both cutting forces 318, 322 without risking severe damage to the cutting element 304.

Figure 7A:
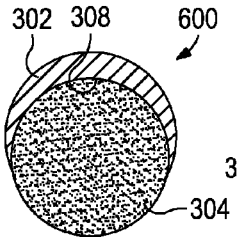
FIGS. 7A-7L illustrate several different embodiments of the cutter of FIG. 6 that may be implemented, according to the present disclosure.
Figure 7B:
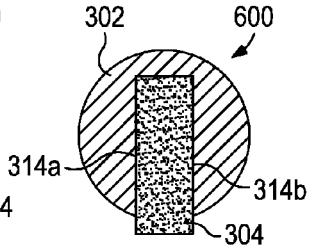
Figure 7C:
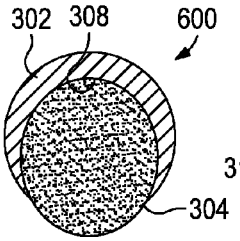
Figure 7D:
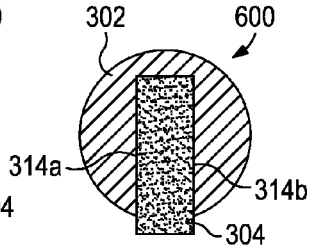
Figure 7E:
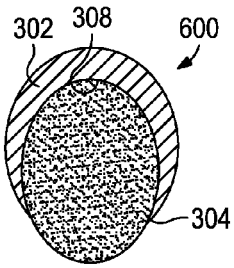
Figure 7F:
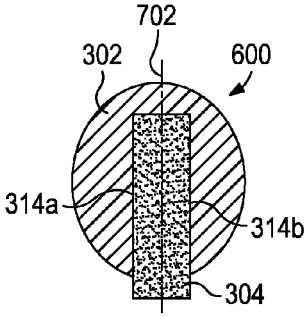

Referring now to FIGS. 7A-7L, with continued reference to FIG. 6, illustrated are several different embodiments of the cutter 600 that may be implemented, according to the present disclosure. In FIGS. 7A and 7B, for example, illustrated are first and second cross-sectional side views, respectively, of one embodiment of the cutter 600. As illustrated, the cutting element 304 may be generally circular or disc-shaped and secured within the slot 308 defined in the substrate 302. At least a portion of the cutting element 304 may extend past and otherwise out of the slot 308 in the substrate 302. As such, the exposed portion of the cutting element 304 may be configured to contact and cut the formation 206 (FIG. 6) during drilling.

In FIGS. 7C and 7D, illustrated are first and second cross-sectional side views, respectively, of another embodiment of the cutter 600. As illustrated, the cutting element 304 may be generally ovoid or elliptical in shape. Again, as secured within the slot 308, at least a portion of the cutting element 304 extends past and otherwise out of the slot 308 of the substrate 302 in order to make contact with and cut the formation 206 (FIG. 6) during drilling.

In FIGS. 7E and 7F, illustrated are first and second cross-sectional side views, respectively, of another embodiment of the cutter 600. The cutter 600 in FIGS. 7E and 7F may be similar to the cutter 600 of FIGS. 7C and 7D in that the cutting element 304 may be generally ovoid or elliptical in shape. The substrate 302 of the cutter 600 in FIGS. 7E and 7F, however, may also be elliptical or ovoid in shape. In some embodiments, the slot 308 may be defined along a longitudinal axis 702 extending along the oblong length of the elliptically-shaped substrate 302, as shown in FIG. 7F. In other embodiments, the slot 308 may be defined orthogonal to the longitudinal axis 702, without departing from the scope of the disclosure.

Figure 7G:
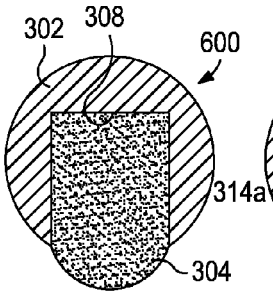
Figure 7H:
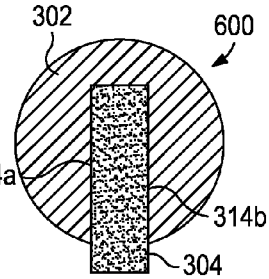
Figure 7I:
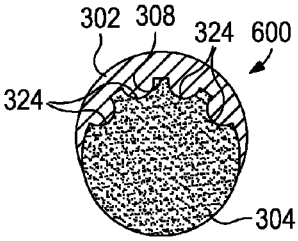

In FIGS. 7G and 7H, illustrated are first and second cross-sectional side views, respectively, of another embodiment of the cutter 600. As illustrated, the cutting element 304 may be generally shaped as an arched or arcuate polygon (i.e., a bullnose). A semi-circular or arched portion of the arcuate polygon extends past and otherwise out of the slot 308 in the substrate 302 in order to make contact with and cut the formation 206 (FIG. 6) during drilling.

In FIGS. 71 and 73, illustrated are first and second cross-sectional side views, respectively, of another embodiment of the cutter 600. As illustrated, the cutting element 304 may be generally circular or disc-shaped, but may further provide a non-linear interface between the slot 308 and the portion of the cutting element 304 that is embedded within the slot 308. More particularly, the cutting element 304 may define one or more grooves or notches 324 that may be spaced about the periphery of the portion of the cutting element 304 embedded within the slot 308. The remaining portion of the cutting element 304 extends past and otherwise out of the slot 308 of the substrate 302 in order to make contact with and cut the formation 206 (FIG. 3) during drilling.

Figure 7J:
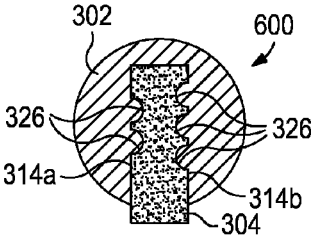

One or more additional grooves or notches 326 may further be provided or otherwise defined in one or both of the front and back faces 314*a,b* of the cutting element 304, as depicted in FIG. 7J. As illustrated, the notches 326 may be transversely-extending channels extending across at least a portion of the diameter of the cutting element 304. In other embodiments, however, the notches 326 may be longitudinally-extending channels (not shown) extending across at least a portion of the diameter of the cutting element 304, without departing from the scope of the disclosure.

Figure 7K:
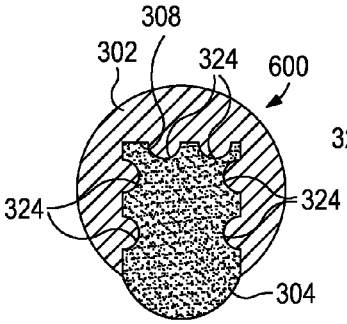
Figure 7L:
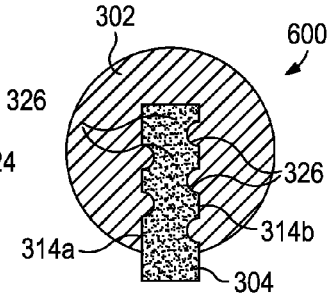

In FIGS. 7K and 7L, illustrated are first and second cross-sectional side views, respectively, of another embodiment of the cutter 600. Similar to the cutter 600 of FIGS. 7G and 7H, the cutting element 304 in FIGS. 7K and 7L may be generally shaped as an arched or arcuate polygon, where a semi-circular or arched portion of the arcuate polygon extends past and otherwise out of the slot 308 of the substrate 302. Moreover, similar to the cutter 600 of FIGS. 71 and 73, the cutter 600 of FIGS. 7K and 7L may define a non-linear interface between the slot 308 and the cutting element 304 in the form of one or more grooves or notches 324 and/or 326. The notches 324 (FIG. 7K) may be defined about the periphery of the portion of the cutting element 304 embedded within the slot 308, and the notches 326 may be transversely-extending channels extending across at least a portion of the width of the cutting element 304. In other embodiments, however, the notches 326 (FIG. 7L) may be longitudinally-extending channels (not shown) extending across at least a portion of the length of the cutting element 304, without departing from the scope of the disclosure.

Figure 8:
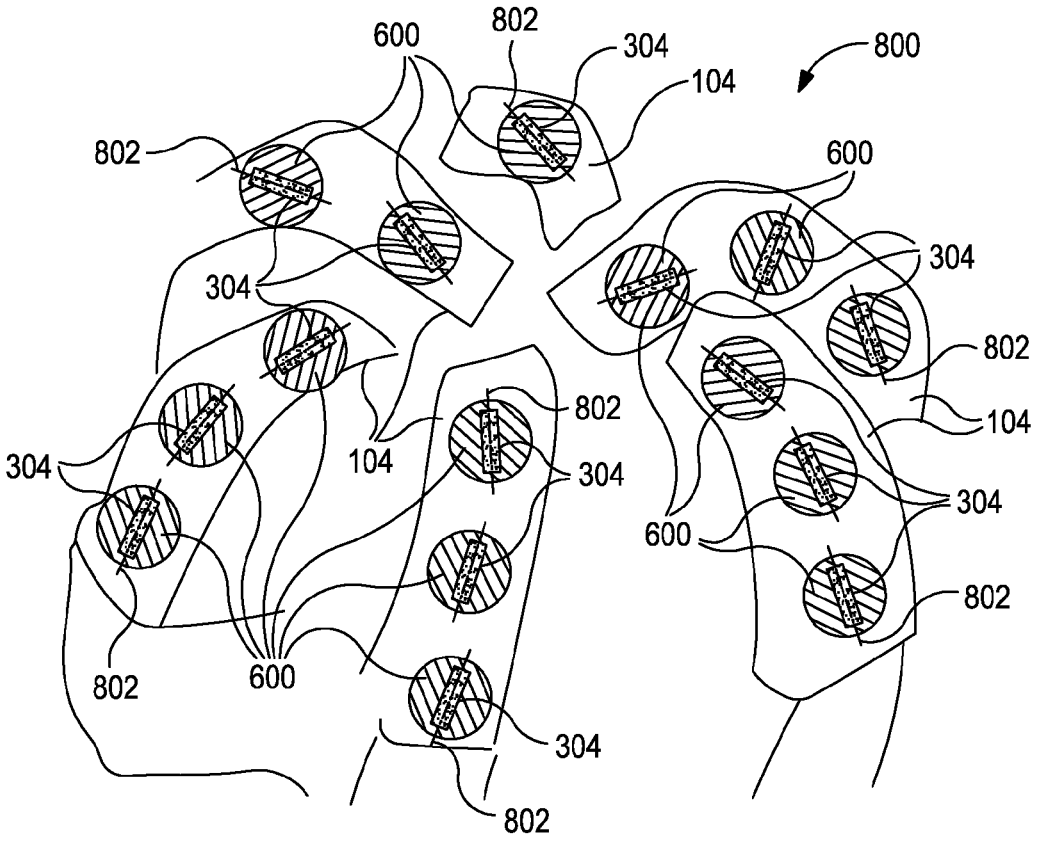
FIG. 8 illustrates a schematic diagram of an exemplary drill bit configured to receive and secure the cutters of FIGS. 7A-7L, according to one or more embodiments.

Referring now to FIG. 8, with continued reference to FIG. 6 and FIGS. 7A-7L, illustrated is a schematic diagram of an exemplary drill bit 800 configured to receive and secure a plurality of cutters 600, according to one or more embodiments. The drill bit 800 may be similar in some respects to the drill bits 100 and 500 of FIGS. 1 and 5, respectively, and may therefore be best understood with reference thereto, where like numerals represent like elements not described again. The basic design of the drill bit 800 is depicted in FIG. 8 for illustrative purposes only and for the intent of showing the general placement of the cutters 600 described above on the drill bit 800.

As illustrated, the drill bit 800 may include a plurality of blades 104 and the cutters 600 may be strategically coupled to the blades 104. The cutters 600 shown in FIG. 8 may be any of the cutters 600 described above with reference to FIGS. 7A-7L. In some embodiments, a combination of the different types of cutters 600 of FIGS. 7A-7L may be employed, without departing from the scope of the disclosure. Each cutter 600 may be attached to the corresponding blades 104 by brazing or other known attachment means.

Each cutter 600 may be generally arranged in the middle (i.e., generally centralized between the front and back of each blade 104) of its corresponding blade 104 and the cutting element 304 of each cutter 600 may be generally aligned with the geometry of the blade 104. In other words, each cutting element 304 may include a widthwise axis 802 that may be aligned with the geometry of the blade 104 at the point at which it is coupled thereto. In some embodiments, the angle of the axis 802 with respect to the geometry of the corresponding blade 104 may be altered, depending on the type of rock to be drilled or the hardness of the formation 206 (FIG. 6). Since the cutters 600 are generally arranged in the middle of their corresponding blades 104, either the front of each blade 104 or its back (or both) may be designed to control the depth of cut 312 (FIG. 6) for the drill bit 800.

Figure 9:
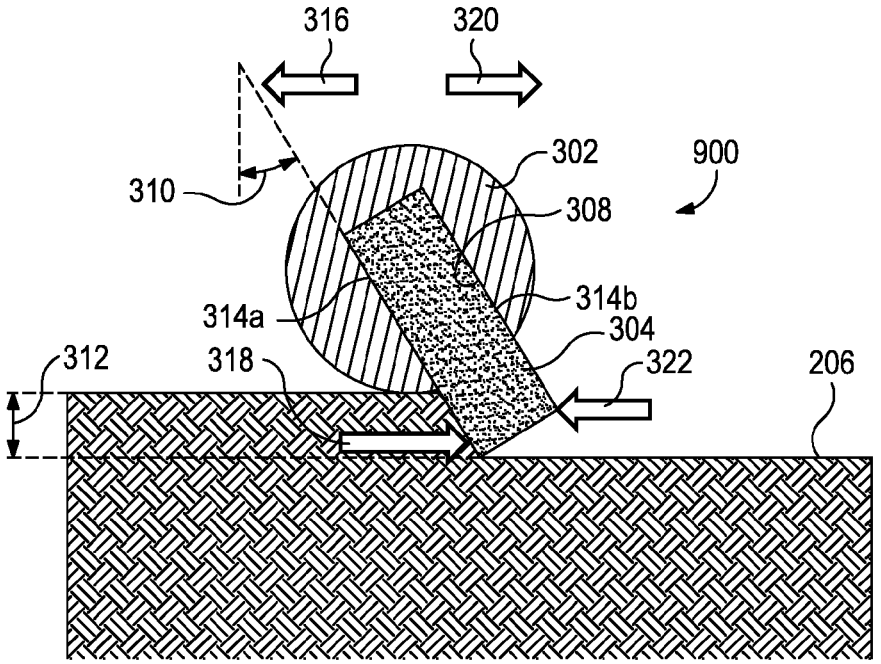
FIG. 9 illustrates a cross-sectional view of another exemplary cutter, according to one or more embodiments of the present disclosure.

Referring now to FIG. 9, illustrated is a cross-sectional view of another exemplary cutter 900, according to one or more embodiments of the present disclosure. The cutter 900 may be similar in at least some respects to the cutters 300 and 600 of FIGS. 3 and 6, respectively, and therefore may be best understood with reference thereto where like numerals again represent like element not described again. Similar to the cutters 300 and 600, the cutter 900 may include a substrate 302 and a cutting element 304 secured or otherwise attached thereto. Moreover, similar to the cutter 300 of FIG. 3, the substrate 302 may be generally cylindrical in shape. Unlike the cutter 300, however, the slot 308 may be defined longitudinally in the substrate 302 at an intermediate point between the opposing ends of the cylindrical shape, as will be better seen in FIGS. 10A-10L. Accordingly, the cutting element 304 may be received and otherwise secured within the slot 308 at an intermediate point along an axial length of the substrate 302.

Again, at least a portion of the cutting element 304 may extend out of the slot 308 in order to make contact with and cut the formation 206. The carbide substrate 302 is brazed onto a corresponding blade 104, as will be described in more detail below. In some embodiments, the cutter 900 may be secured to the blade 104 at the back rake angle 310 described above.

The cutting element 304 may again define a front face 314*a* and a back face 314*b*. Since the cutting element 304 is at least partially inserted or otherwise embedded within the substrate 302, portions of the front and back faces 314*a,b* are in direct contact with and otherwise supported by the substrate 302. As a result, the cutting element 304 may be supported and protected in both rotational cutting directions 316, 320. More particularly, since both the front and back faces 314*a,b* of the cutting element 304 are directly interfaced with the substrate 302, any resulting stresses placed on the cutting element 304 as it turns either normally (i.e., the first direction 316) or in reverse bit rotation (i.e., the second direction 320) will be assumed by the cutter 900 in compression against the substrate 302. As a result, the cutter 900 may be able to be subjected to both cutting forces 318, 322 without risking severe damage to the cutting element 304.

Figure 10A:
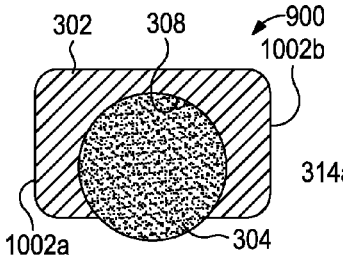
FIGS. 10A-10L illustrate several different embodiments of the cutter of FIG. 9 that may be implemented, according to the present disclosure.
Figure 10B:
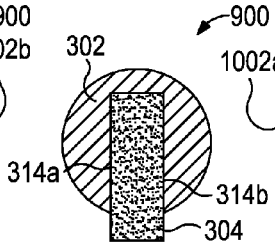
Figure 10C:
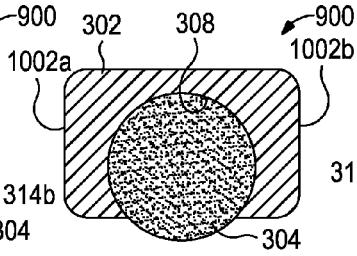
Figure 10D:
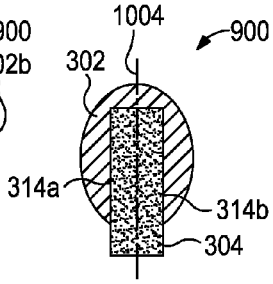

Referring now to FIGS. 10A-10L, with continued reference to FIG. 9, illustrated are several different embodiments of the cutter 900 that may be implemented, according to the present disclosure. In FIGS. 10A and 10B, for example, illustrated are cross-sectional side and end views, respectively, of one embodiment of the cutter 900. As illustrated, the cutting element 304 may be generally circular or disc-shaped and secured within the slot 308 defined in the substrate 302. More particularly, the substrate 302 may have opposing first and second ends 1002*a* and 1002*b*, respectively, and the slot 308 may be defined in the body of the substrate 302 at an intermediate location between each end 1002*a,b*. At least a portion of the cutting element 304 may extend past and otherwise out of the slot 308 in the substrate 302. As such, the exposed portion of the cutting element 304 may be configured to contact and cut the formation 206 (FIG. 9) during drilling In FIGS. 10C and 10D, illustrated are cross-sectional side and end views, respectively, of another embodiment of the cutter 900. The cutter 900 in FIGS. 10C and 10D may be similar to the cutter 900 of FIGS. 10A and 10B in that the cutting element 304 may be generally circular or disc-shaped. The substrate 302 of the cutter 900 in FIGS. 10C and 10D, however, may be elliptical or ovoid when seen in the cross-sectional end view, as in FIG. 10D. As used herein, the term "cylindrical" as applied to the substrate 302 is intended to encompass any arcuate or circular volume or shape including, but not limited to, elliptical or ovoid volumes, such as is depicted in FIG. 10D. In some embodiments, the slot 308 may be defined along a longitudinal axis 1004 extending along the oblong length of the elliptically-shaped substrate 302, as shown in FIG. 10D. In other embodiments, the slot 308 may be defined orthogonal to the longitudinal axis 1004, without departing from the scope of the disclosure.

Figure 10E:
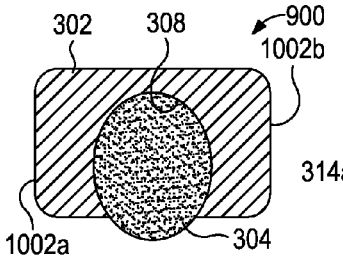
Figure 10F:
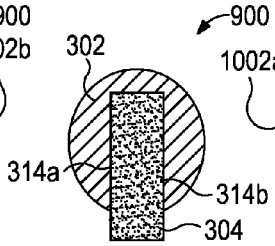

In FIGS. 10E and 10F, illustrated are cross-sectional side and end views, respectively, of another embodiment of the cutter 900. As illustrated, the cutting element 304 may be generally ovoid or elliptical in shape. Again, as secured within the slot 308 defined at an intermediate location between the first and second ends 1002*a,b* of substrate 302, at least a portion of the cutting element 304 extends past and otherwise out of the slot 308 of the substrate 302 in order to make contact with and cut the formation 206 (FIG. 9) during drilling.

Figure 10G:
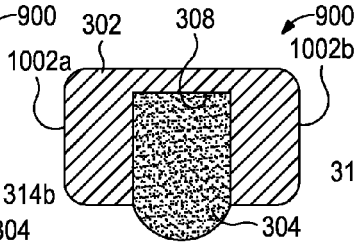
Figure 10H:
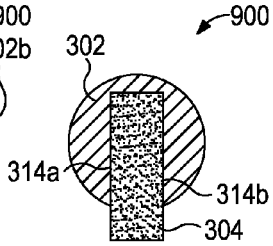

In FIGS. 10G and 10H, illustrated are cross-sectional side and end views, respectively, of another embodiment of the cutter 900. As illustrated, the cutting element 304 may be generally shaped as an arched or arcuate polygon. A semi-circular or arched portion of the arcuate polygon extends past and otherwise out of the slot 308 defined at an intermediate location between the first and second ends 1002*a,b* of the substrate 302 in order to make contact with and cut the formation 206 (FIG. 9) during drilling.

Figure 10I:
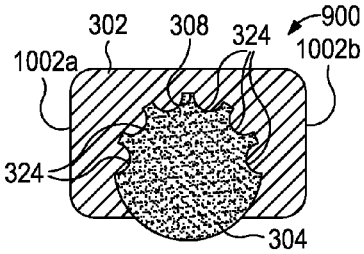
Figure 10J:
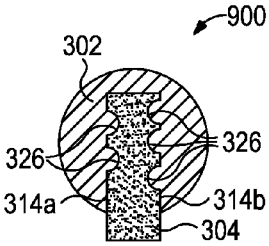

In FIGS. 10I and 10J, illustrated are cross-sectional side and end views, respectively, of another embodiment of the cutter 900. As illustrated, the cutting element 304 may be generally circular or disc-shaped, but may further provide a non-linear interface between the slot 308 and the portion of the cutting element 304 embedded within the slot 308. More particularly, the cutting element 304 may define one or more grooves or notches 324 that may be spaced about the periphery of the portion of the cutting element 304 embedded within the slot 308. The remaining portion of the cutting element 304 extends past and otherwise out of the slot 308 in the substrate 302 in order to make contact with and cut the formation 206 (FIG. 9) during drilling.

One or more additional grooves or notches 326 may further be provided or otherwise defined in one or both of the front and back faces 314*a,b* of the cutting element 304, as depicted in FIG. 10J. As illustrated, the notches 326 may be transversely-extending channels extending across at least a portion of the diameter of the cutting element 304. In other embodiments, however, the notches 326 may be longitudinally-extending channels extending across at least a portion of the diameter of the cutting element 304, without departing from the scope of the disclosure.

Figure 10K:
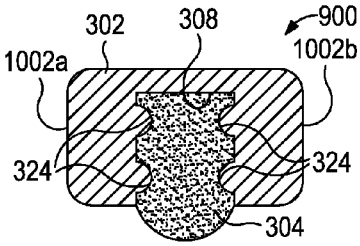
Figure 10L:
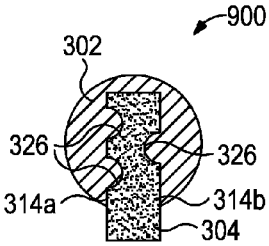

In FIGS. 10K and 10L, illustrated are cross-sectional side and end views, respectively, of another embodiment of the cutter 900. Similar to the cutter 900 of FIGS. 10G and 10H, the cutting element 304 in FIGS. 10K and 10L may be generally shaped as an arched or arcuate polygon, where a semi-circular or arched portion of the arcuate polygon extends past and otherwise out of the slot 308 of the substrate 302. Moreover, similar to the cutter 900 of FIGS. 10I and 10J, the cutter 900 of FIGS. 10K and 10L may define a non-linear interface between the slot 308 and the cutting element 304 in the form of one or more grooves or notches 324 and/or 326. The notches 324 may be defined about the periphery of the portion of the cutting element 304 embedded within the slot 308, and the notches 326 may be transversely-extending channels extending across at least a portion of the width of the cutting element 304. In other embodiments, however, the notches 326 may be longitudinally-extending channels extending across at least a portion of the length of the cutting element 304, without departing from the scope of the disclosure.

Figure 11:
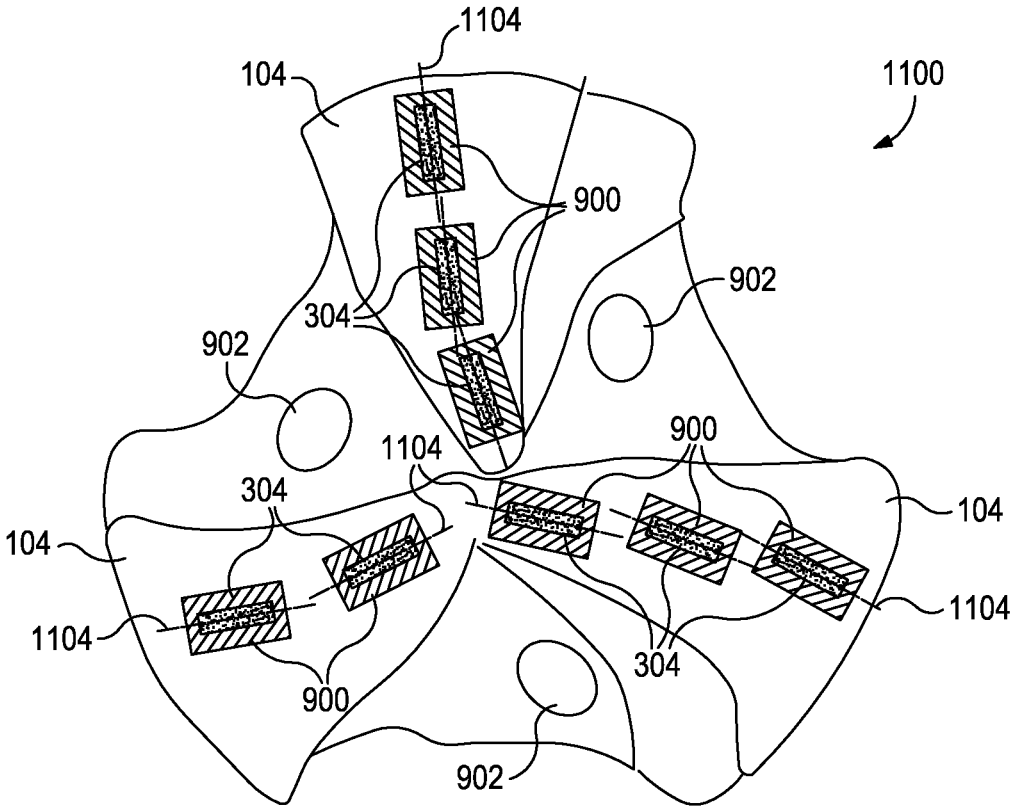
FIG. 11 illustrates a schematic diagram of an exemplary drill bit configured to receive and secure the cutters of FIGS. 10A-10L, according to one or more embodiments.

Referring now to FIG. 11, with continued reference to FIG. 9 and FIGS. 10A-10L, illustrated is a schematic diagram of an exemplary drill bit 1100 configured to receive and secure a plurality of the cutters 900 therein, according to one or more embodiments. The drill bit 1100 may be similar in some respects to the drill bits 100, 500, and 800 of FIGS. 1, 5, and 8, respectively, and may therefore be best understood with reference thereto, where like numerals represent like elements not described again. The basic design of the drill bit 1100 is depicted in FIG. 11 for illustrative purposes only and for the intent of showing the general placement of the cutters 900 described above on the drill bit 1100.

As illustrated, the drill bit 1100 may include a plurality of blades 104 (three shown) and the cutters 900 may be strategically coupled to the blades 104. Also shown are three ports 902 that may provide a conduit for fluids to be ejected out of the drill bit 1100, as briefly described above. The cutters 900 shown in FIG. 11 may be any of the cutters 900 described above with reference to FIGS. 10A-10L. In some embodiments, a combination of the different types of cutters 900 of FIGS. 10A-10L may be employed, without departing from the scope of the disclosure. Each cutter 900 may be attached to the corresponding blades 104 by brazing or other known attachment means.

Each cutter 900 may be generally arranged in the middle (i.e., generally centralized between the front and back of each blade 104) of its corresponding blade 104 and the cutting element 304 of each cutter 900 may be generally aligned with the geometry of the blade 104. In other words, each cutting element 304 may include a widthwise axis 1104 that may be aligned with the geometry of the blade 104 at the point at which it is coupled thereto. In some embodiments, the angle of the axis 1104 with respect to the geometry of the corresponding blade 104 may be altered, depending on the type of rock to be drilled or the hardness of the formation 206 (FIG. 9). Since the cutter 900 is generally arranged in the middle of its corresponding blade 104, either the front of each blade 104 or its back (or both) may be designed to control the depth of cut 312 (FIG. 9) for the drill bit 1100.

Embodiments disclosed herein include:

A. A cutter for a drill bit that may include a substrate defining a slot therein and being configured to be coupled to a middle portion of a blade of the drill bit, and a cutting element secured within the slot and having at least a portion of the cutting element extending out of the slot, the cutting element further having a first face and a second face, wherein portions of the first and second faces are supported by the substrate within the slot.

B. A method that may include rotating a drill bit to cut through a formation, the drill bit comprising at least one cutter coupled to a drill bit blade and the at least one cutter having a substrate and a cutting element secured within a slot defined in the substrate, wherein at least a portion of the cutting element extends out of the slot to contact the formation. The method may also include resisting cutting forces generated by the formation with the cutting element, the cutting element having a first face and a second face supported at least partially by the substrate as secured within the slot.

Each of embodiments A and B may have one or more of the following additional elements in any combination: Element 1: wherein the substrate is made of tungsten carbide. Element 2: wherein the cutting element is made of one or more layers of polycrystalline diamond. Element 3: wherein the substrate is cylindrical or spherical. Element 4: wherein the cutting element is disc-shaped, elliptical, ovoid, or arcuate polygonal. Element 5: wherein the cutting element defines one or more notches that result in a non-linear interface between the slot and portions of the cutting element embedded within the slot. Element 6: wherein the notches are defined in at least one of the periphery of the cutting element and one or both of the front and back faces of the cutting element. Element 7: wherein the substrate is cylindrical and has opposing first and second ends, the slot being defined in the first end and the second end being coupled to the blade of the drill bit. Element 8: wherein the substrate provides an extension that extends longitudinally from the first end such that all or a portion of the front or back face is in direct contact with the substrate. Element 9: wherein the cutting element is secured within the slot at an angle with respect to a longitudinal axis of the cutter. Element 10: wherein the substrate is cylindrical and has opposing first and second ends, the slot being defined in the substrate at an intermediate location between the first and second ends. Element 11: wherein the substrate is coupled to the blade lengthwise.

Element 12: wherein rotating the drill bit comprises rotating the drill bit in a first direction such that a first cutting force is applied to the cutter, resisting the first cutting force in compression with the back face of the cutting element as supported by the substrate, and resisting a second cutting force in compression with the front face of the cutting element as supported by the substrate in the event the drill bit rotates in a second direction opposite the first direction. Element 13: further comprising coupling the at least one cutter to a middle portion of the drill bit blade. Element 14: wherein the substrate is cylindrical or spherical and the cutting element is disc-shaped, elliptical, ovoid, or arcuate polygonal, the method further comprising securing the cutting element within the slot with a non-linear interface between the slot and portions of the cutting element embedded within the slot. Element 15: wherein the substrate is cylindrical and provides opposing first and second ends, the slot being defined in the first end and the method further comprising coupling the cutter to the drill bit blade by inserting the second end of the substrate into a hole defined in the drill bit blade. Element 16: further comprising coupling the cutter to the drill bit blade at a back rake angle. Element 17: further comprising securing the cutting element within the slot at an angle with respect to a longitudinal axis of the cutter. Element 18: wherein the substrate is cylindrical and has opposing first and second ends, the slot being defined at an intermediate location between the first and second ends, the method further comprising coupling the substrate lengthwise to the at least one blade.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A cutter for a drill bit, comprising:

a substrate defining a slot therein and being configured to be coupled to a middle portion of a blade of the drill bit; and an arcuate polygonal cutting element having a polygonal portion secured within the slot and an arcuate portion of the cutting element extending out of the slot, the cutting element further having a planar first face and a planar second face opposite the first face, wherein each of the first and second faces extends across the polygonal portion and the arcuate portion, wherein portions of the first and second faces are supported by the substrate within the slot.

2. The cutter of claim 1, wherein the substrate is made of tungsten carbide.

3. The cutter of claim 1, wherein the cutting element is made of one or more layers of polycrystalline diamond.

4. The cutter of claim 1, wherein the substrate is cylindrical or spherical.

5. The cutter of claim 4, wherein the cutting element defines one or more notches that result in a non-linear interface between the slot and portions of the cutting element embedded within the slot.

6. The cutter of claim 5, wherein the one or more notches are defined in at least one of the periphery of the cutting element and one or both of the first and second faces of the cutting element.

7. The cutter of claim 4, wherein the substrate is cylindrical and has opposing first and second ends, the slot being defined in the first end and the second end being coupled to the blade of the drill bit.

8. The cutter of claim 7, wherein the substrate provides an extension that extends longitudinally from the first end such that all or a portion of the first or second face is in direct contact with the substrate.

9. The cutter of claim 8, wherein the cutting element is secured within the slot at an angle with respect to a longitudinal axis of the cutter.

10. The cutter of claim 4, wherein the substrate is cylindrical and has opposing first and second ends, the slot being defined in the substrate at an intermediate location between the first and second ends.

11. The cutter of claim 10, wherein the substrate is coupled to the blade lengthwise.

12. The cutter of claim 1, wherein the planar first face is parallel to the planar second face.

13. A method, comprising:

rotating a drill bit to cut through a formation, the drill bit comprising at least one cutter coupled to a drill bit blade and the at least one cutter having a substrate and an arcuate polygonal cutting element having a polygonal portion secured within a slot defined in the substrate, wherein an arcuate portion of the cutting element extends out of the slot to contact the formation, the cutting element further having a planar first face and a planar second face opposite the first face, wherein each of the first and second faces extends across the polygonal portion and the arcuate portion; and resisting cutting forces generated by the formation with the cutting element, the cutting element having a first face and a second face supported at least partially by the substrate as secured within the slot.

14. The method of claim 13, wherein rotating the drill bit comprises:

rotating the drill bit in a first direction such that a first cutting force is applied to the cutter;

resisting the first cutting force in compression with the first face of the cutting element as supported by the substrate; and resisting a second cutting force in compression with the second face of the cutting element as supported by the substrate in the event the drill bit rotates in a second direction opposite the first direction.

15. The method of claim 13, further comprising coupling the at least one cutter to a middle portion of the drill bit blade.

16. The method of claim 13, wherein the substrate is cylindrical or spherical, the method further comprising securing the cutting element within the slot with a non-linear interface between the slot and portions of the cutting element embedded within the slot.

17. The method of claim 16, wherein the substrate is cylindrical and provides opposing first and second ends, the slot being defined in the first end and the method further comprising coupling the cutter to the drill bit blade by inserting the second end of the substrate into a hole defined in the drill bit blade.

18. The method of claim 17, further comprising coupling the cutter to the drill bit blade at a back rake angle.

19. The method of claim 13, further comprising securing the cutting element within the slot at an angle with respect to a longitudinal axis of the cutter.

20. The method of claim 19, wherein the substrate is cylindrical and has opposing first and second ends, the slot being defined at an intermediate location between the first and second ends, the method further comprising coupling the substrate lengthwise to the at least one blade.

* * * * *